US007343130B2

(12) United States Patent
Nakayama

(10) Patent No.: US 7,343,130 B2
(45) Date of Patent: Mar. 11, 2008

(54) IMAGE HEATING APPARATUS AND FIXING APPARATUS

(75) Inventor: Toshinori Nakayama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/749,934

(22) Filed: May 17, 2007

(65) Prior Publication Data

US 2007/0212131 A1 Sep. 13, 2007

Related U.S. Application Data

(62) Division of application No. 11/092,772, filed on Mar. 30, 2005, now Pat. No. 7,260,351.

(30) Foreign Application Priority Data

Apr. 1, 2004 (JP) ..... 2004-109088

(51) Int. Cl.
*G03G 15/20* (2006.01)

(52) U.S. Cl. ..... 399/323

(58) Field of Classification Search ..... 399/320–342, 399/67–70; 219/216
See application file for complete search history.

(56) References Cited

U.S. PATENT DOCUMENTS

| | | | | |
|---|---|---|---|---|
| 4,712,908 | A | 12/1987 | Nakayama et al. | 355/14 SH |
| 5,140,380 | A | 8/1992 | Nakamura et al. | 355/324 |
| 5,177,548 | A | 1/1993 | Nakamura et al. | 355/324 |
| 5,240,362 | A | 8/1993 | Nakayama et al. | 412/11 |
| 5,530,556 | A | 6/1996 | Miura et al. | 358/300 |
| 6,377,775 | B1 | 4/2002 | Nakayama et al. | 399/328 |
| 6,456,818 | B1 | 9/2002 | Nakayama et al. | 399/328 |
| 6,564,032 | B2 | 5/2003 | Hara et al. | 399/328 |
| 6,687,481 | B2 | 2/2004 | Watanabe et al. | 399/328 |
| 6,704,536 | B2 | 3/2004 | Nakayama | 399/328 |
| 6,978,110 | B2 | 12/2005 | Nakayama | 399/330 |
| 7,079,801 | B2 | 7/2006 | Nakayama | 399/330 |
| 2003/0016971 | A1 | 1/2003 | Kikuchi et al. | 399/323 |
| 2005/0220506 | A1 | 10/2005 | Nakayama | 399/323 |
| 2006/0088326 | A1 | 4/2006 | Nakayama | 399/69 |

FOREIGN PATENT DOCUMENTS

| | | | |
|---|---|---|---|
| JP | 63192068 A | * | 8/1988 |
| JP | 01-277272 A | | 11/1989 |
| JP | 06083221 A | * | 3/1994 |
| JP | 6-250542 | | 9/1994 |
| JP | 6-258970 | | 9/1994 |
| JP | 11194684 A | * | 7/1999 |
| JP | 2002123108 A | * | 4/2002 |
| JP | 2004-177568 | | 6/2004 |

* cited by examiner

*Primary Examiner*—David M. Gray
*Assistant Examiner*—Ryan D. Walsh
(74) *Attorney, Agent, or Firm*—Fitzpatrick, Cella, Harper & Scinto

(57) ABSTRACT

An image heating apparatus including a plurality of image heating devices, each of the plurality of image heating devices having: an image heating member that heats an image on a recording material; and a separation member that separates the recording material from the image heating member, wherein the recording material is caused to first pass through the image heating device on an upstream side with respect to a conveying direction of the recording material and then pass through the image heating device on a downstream side, and wherein the separation member of the image heating device on the upstream side and the separation member of the image heating device on the downstream side are different from each other.

5 Claims, 8 Drawing Sheets

IMAGE HEATING APPARATUS AND FIXING APPARATUS

CROSS-REFERENCE TO RELATED APPLICATION

This application is a divisional of U.S. patent application Ser. No. 11/092,772, filed Mar. 30, 2005, the content of which is incorporated by reference herein.

BACKGROUND OF THE INVENTION

1. Field of the Invention

The present invention relates to an image heating apparatus that heats an image formed on a recording material in an image forming apparatus such as a copying machine, facsimile, or a printer.

And the present invention relates to a fixing apparatus that fixes an unfixed image formed on a recording material in an image forming apparatus such as a copying machine, facsimile, or a printer.

More specifically, the present invention relates to an image heating apparatus including multiple image heating means each having an image heating member that heats an image on a recording material and a separation member that separates the recording material from the image heating member, the image heating apparatus allowing the recording material to first pass through an image heating means on an upstream side with respect to a conveying direction of the recording material and then pass through an image heating means on a downstream side.

2. Related Background Art

Image forming apparatuses such as a copying machine, which utilize an electrophotographic process includes an image heating apparatus that heats an image (unfixed developer image) formed on a sheet (recording material) through transfer or directly.

As the image heating apparatus, in recent years, image heating apparatuses including multiple image heating means are becoming popular with an increase in speed of paper passing and an improvement in image quality (see Japanese Patent Application Laid-Open No. H06-258970, for instance).

Such an image heating apparatus has multiple image heating means arranged along a conveying direction of the recording material, the multiple image heating means including image heating members that contact a recording material, on which an unfixed image is borne, and heat the image. Image heating is performed by causing the recording material to pass through the multiple image heating means in succession.

Such an image heating apparatus including multiple image heating means has such a feature that, for instance, a recording material on which an unfixed image is borne, is caused to first pass through a first image heating means on the most upstream side in a conveying direction of the recording material for image heating and fixing and then pass through a second image heating means on an downstream side for image reheating. Generally, many of such image heating apparatuses are intended to ensure a certain degree of a fixation property at the first image heating means and to achieve high image quality (high gloss) at the second image heating means. In particular, the glossiness of an image is greatly influenced by the second image heating means on the downstream side in the recording material conveying direction.

In such an image heating apparatus as well, in order to enhance separation property at the time of image fixation onto a first surface and a second surface of a recording material, it is effective to provide a separation member for each image heating member.

Incidentally, while it is possible to significantly enhance the separation property by bringing a separation claw into abutment against the image heating member, there occurs a problem in that a surface of the image heating member is damaged by the separation claw. Also, while it is possible to alleviate the damage by reciprocating the abutment separation claw, the separation claw and an image surface rub against each other, causing the surface property of a heating roller to partially change, and therefore gloss unevenness occurs. Accordingly, the provision of the separation claw has both an advantage that the separation property is improved and a disadvantage that the gloss unevenness occurs.

In addition, when the separation member of the image heating means on the upstream side and the separation member of the image heating means on the downstream side have the same construction, the following problems occur.

The image heating means on the upstream side is required to ensure sufficient separation performance because an entirely unfixed image and the image heating member contact each other and a strong adhesive force occurs between fused toner and the image heating member. On the other hand, separation property at the time when an image heated once is re-heated is high as compared with the case of heating at the image heating means on the upstream side, so it is possible to ensure a sufficient separation property even when the separation performance is lowed as compared with that at the image heating means on the upstream side.

Meanwhile, it is known that the glossiness of an image greatly depends on the surface property of the heating member that contacts the image. Consequently, unevenness of the surface property of the heating member ascribable to the separation member significantly influences unevenness of the image glossiness. Therefore, the glossiness enhancing effect is reduced when multiple image heating means are provided.

Accordingly, when the separation structure of the image heating means on the upstream side is applied to the image heating means on the downstream side, it becomes necessary to shorten the replacement cycle for the image heating member for the sake of elimination of gloss unevenness.

In particular, the problems described above become serious when stable separation property is to be obtained at the time of image heating intended for color image fixation, an increase in speed, and high productivity.

SUMMARY OF THE INVENTION

The present invention has an object to provide an image heating apparatus with which it is possible to reduce image gloss unevenness while improving separation property in a construction where multiple image heating member are provided.

The present invention has an object to provide a fixing apparatus with which it is possible to reduce image gloss unevenness while improving separation property in a construction where multiple fixing member are provided.

The present invention has an object to provide an image heating apparatus comprising:

a first image heating member that heats an image on a recording material;

a first separation member that separates the recording material from the first image heating member;

a second image heating member that heats the image on the recording material heated by the first image heating member; and a second separation member that separates the recording material from the second image heating member, wherein structure of the first separation member and structure of the second separation member are different from each other.

The present invention has an object to provide a fixing apparatus comprising:

a first fixing member that fixes an image on a recording material at a first nip;

a first separation member that separates the recording material from the first fixing member;

a second fixing member that fixes the image on the recording material fixed by the first fixing member at a second nip; and a second separation member that separates the recording material from the second fixing member, wherein structure of the first separation member and structure of the second separation member are different from each other.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Hereinbelow, the present invention is described more specifically by way of its embodiments. It is to be noted that although the following embodiments exemplify the best mode for carrying out the present invention, the present invention is not to be limited to those embodiments.

Embodiment 1

(1) Example of Image Forming Apparatus

Figure 1:
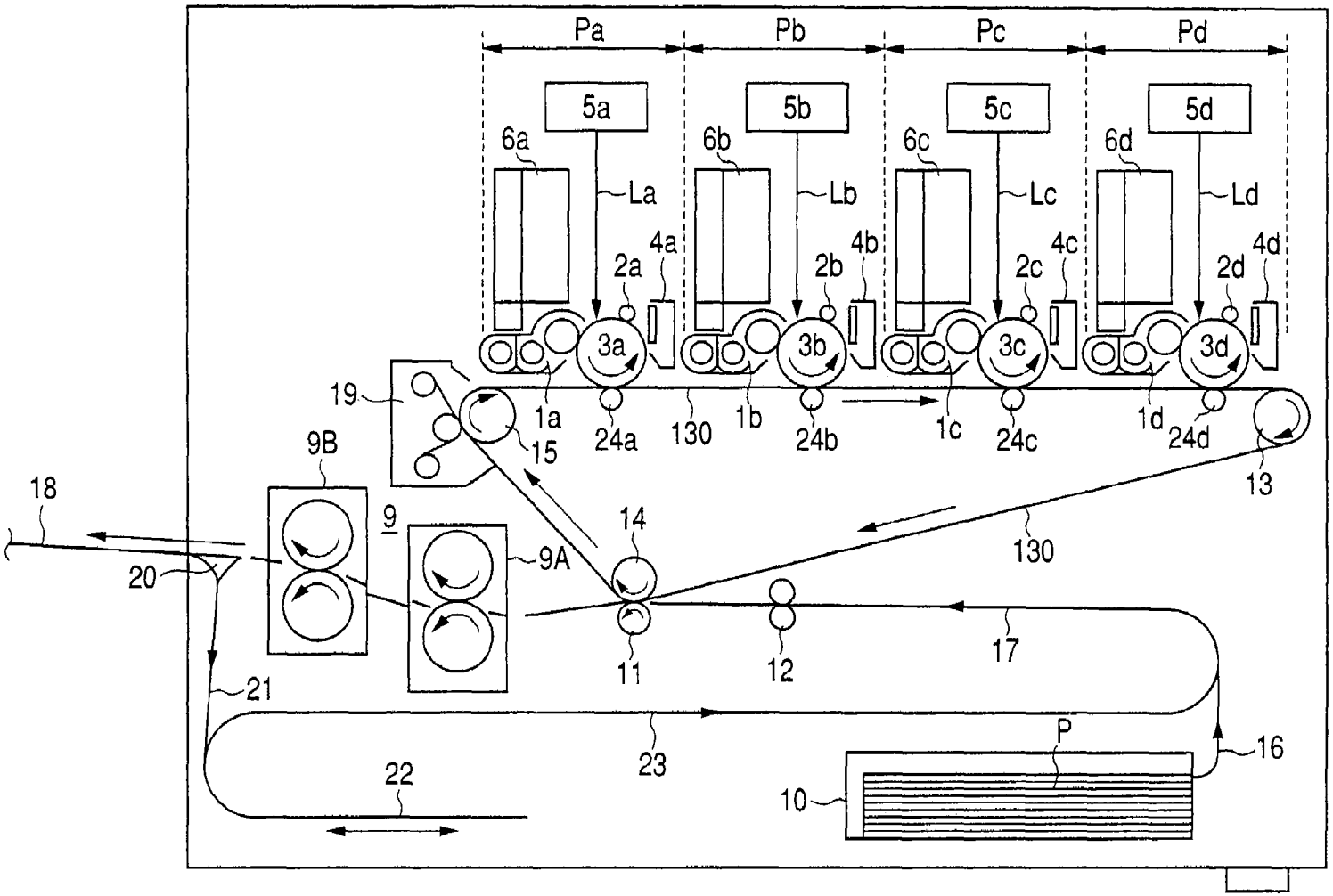
FIG. 1 is a schematic structural diagram of an image forming apparatus according to Embodiment 1 of the present invention.

FIG. 1 is a schematic structural diagram showing an example of an image forming apparatus. The image forming apparatus of this embodiment is a tandem type color laser printer employing a transfer type electrophotographic process.

Arranged inside the image forming apparatus are four image forming portions, that is, first, second, third, and fourth image forming portions Pa, Pb, Pc, and Pd, where toner images of respectively different colors are formed through the process of latent image formation, developing, and transfer.

The image forming portions Pa, Pb, Pc, and Pd are equipped with dedicated image bearing members, which in this embodiment are electrophotographic photosensitive drums 3*a*, 3*b*, 3*c*, and 3*d*, respectively, and toner images of respective colors are formed on the photosensitive drums 3*a*, 3*b*, 3*c*, and 3*d*. Installed adjacent the photosensitive drums 3*a*, 3*b*, 3*c*, and 3*d* is an intermediate transfer member (intermediate transfer belt) 130. Toner images of respective colors that are formed on the photosensitive drums 3*a*, 3*b*, 3*c*, and 3*d* are primarily transferred onto the intermediate transfer member 130 before being transferred onto a recording material P by a secondary transferring portion. Further, the recording material P to which the toner image has been transferred is introduced into an image heating apparatus 9 where the toner image is fixed on the recording material P, before being discharged onto a delivery tray 18 outside the apparatus as a material on which a recording image has been formed. The image heating apparatus 9 has two fixing devices, a first fixing device 9A and a second fixing device 9B, as image heating means. The image heating apparatus 9 is described later.

Provided around the outer peripheries of the photosensitive drums 3*a*, 3*b*, 3*c*, and 3*d* are drum chargers 2*a*, 2*b*, 2*c*, and 2*b*, developing devices 1*a*, 1*b*, 1*c*, and 1*d*, primary transfer chargers 24*a*, 24*b*, 24*c*, and 24*d*, and cleaners 4*a*, 4*b*, 4*c*, and 4*d*, respectively. Laser scanners 5*a*, 5*b*, 5*c*, and 5*d* are further installed in an upper part of the apparatus.

The photosensitive drums 3*a*, 3*b*, 3*c*, and 3*d* are driven to rotate counterclockwise as indicated by the arrows, and their peripheral surfaces are primarily charged in a uniform manner to a predetermined polarity/potential by the drum chargers 2*a*, 2*b*, 2*c*, and 2*d*, respectively. The uniformly charged surfaces of the photosensitive drums 3*a*, 3*b*, 3*c*, and 3*d* are subjected to scanning exposure with light beams La, Lb, Lc, and Ld, which are respectively output from the laser scanners 5*a*, 5*b*, 5*c*, and 5*d* and each modulated according to an image signal, thus forming a latent image corresponding to the image signal on each of the photosensitive drums 3*a*, 3*b*, 3*c*, and 3*d*. That is, a light source device, a polygon mirror, and the like are installed in each of the photosensitive drums 3*a*, 3*b*, 3*c*, and 3*d*; scanning is performed with a laser light beam emitted from the light source device while rotating the polygonal mirror, and the light fluxes of the scanning light are polarized by a reflecting mirror and condensed by an fθ lens onto the generatrix of each of the photosensitive drums 3*a*, 3*b*, 3*c*, and 3*d*, thereby forming the latent image corresponding to the image signal on each of the photosensitive drums 3*a*, 3*b*, 3*c*, and 3*d*.

The developing devices 1*a*, 1*b*, 1*c*, and 1*d* are filled with predetermined amounts of toners of cyan, magenta, yellow, and black as developers by means of supplying devices 6*a*, 6*b*, 6*c*, and 6*d*, respectively. The developing devices 1*a*, 1*b*, 1*c*, and 1*d* develop and visualize latent images on the photosensitive drums 3*a*, 3*b*, 3*c*, and 3*d* as cyan, magenta, yellow, and black toner images, respectively.

The intermediate transfer member 130 is an endless belt member suspended under tension between three parallel rollers 13, 14, and 15, and is driven to rotate clockwise as indicated by the arrows at the same peripheral speed as the photosensitive drums 3*a*, 3*b*, 3*c*, and 3*d*.

Due to the electric field and pressure produced by a primary transfer bias applied to the intermediate transfer member 130, the toner image of the first color, yellow, formed and borne on the photosensitive drum 3*a* of the first image forming portion Pa is primarily transferred to the outer peripheral surface of the intermediate transfer member 130 as it passes through the nip portion between the photosensitive drum 3*a* and the intermediate transfer member 130.

Thereafter, likewise, the toner images of magenta, cyan, and black as the second, third, and fourth colors formed and borne on the photosensitive drums 3*b*, 3*c*, and 3*d* of the second, third, and fourth image forming portions Pb, Pc, and Pd, respectively, are sequentially transferred in a superimposed manner onto the intermediate transfer member 130. A composite color toner image corresponding to the target color image is thus formed on the intermediate transfer member 130.

Of the three rollers 13, 14, and 15 around which the intermediate transfer member 130 is suspended under tension, a secondary transferring roller 11 is held in press contact with the roller 14 while sandwiching the intermediate transfer member 130 therebetween, whereby a secondary transfer nip portion is formed between the secondary transferring roller 11 and the intermediate transfer member 130.

On the other hand, one sheet of the recording material P is separated and fed from a sheet feeding cassette 10, and passes through a sheet path 16, a sheet path 17, a registration roller 12, and a pre-transfer guide before being supplied to the secondary transfer nip portion, which is the contact nip portion between the intermediate transfer member 130 and the secondary transferring roller 11, at a predetermined timing, and is applied with the secondary transfer bias from a bias power source. This effects collective secondary transfer of the composite color toner image, consisting of images transferred and superimposed on the intermediate transfer member 130, onto the recording material P.

After having the composite color toner image transferred thereon at the secondary transfer nip portion, the recording material P is separated from the intermediate transfer member 130 and introduced to the image heating apparatus 9. At this time, the recording material P is first introduced to the first fixing device 9A and then to the second fixing device 9B; as the recording material P thus sequentially passes through the two fixing devices 9A and 9B arranged in series, the toner image is fixed onto the recording material with heat and pressure.

After the primary transfer process, the photosensitive drums 3*a*, 3*b*, 3*c*, and 3*d* are cleaned and removed of transfer residual toner by the cleaners 4*a*, 4*b*, 4*c*, and 4*d*, respectively, leaving them ready for the next latent image formation process.

Toner and any other foreign matter remaining on the transfer belt 130 are wiped off by abutting a cleaning web (non-woven fabric) 19 on the surface of the transfer belt 130.

When the duplex copying mode is selected, the recording material P having an image formed on its first surface and having exit the second fixing device 9B of the image heating apparatus 9 is introduced toward a sheet path 21 on the re-circulation conveying mechanism side by a flapper 20 and then further enters a switchback sheet path 22; thereafter, the recording material P is drawn out from the sheet path 22 and guided toward a re-conveyance sheet path 23, to be introduced from the sheet path 23 to the secondary transfer nip portion, which is the contact nip portion between the intermediate transfer member 130 and the secondary transferring roller 11, again with its front and rear surfaces reversed, after passing through the sheet path 17, the registration roller 12, and the pre-transfer guide. This effects secondary transfer of the toner image on the intermediate transfer member 130 to a second surface of the recording material P. The recording material P, having the toner image thus secondarily transferred on its second surface at the secondary transfer nip portion, is separated from the intermediate transfer member 130 and introduced to the first and second fixing devices 9A and 9B again, where the recording material P is subjected to toner image fixing processing before being discharged onto the delivery tray 18 outside the apparatus as a doubled-sided copy.

(2) Image Heating Apparatus 9

Figure 2:
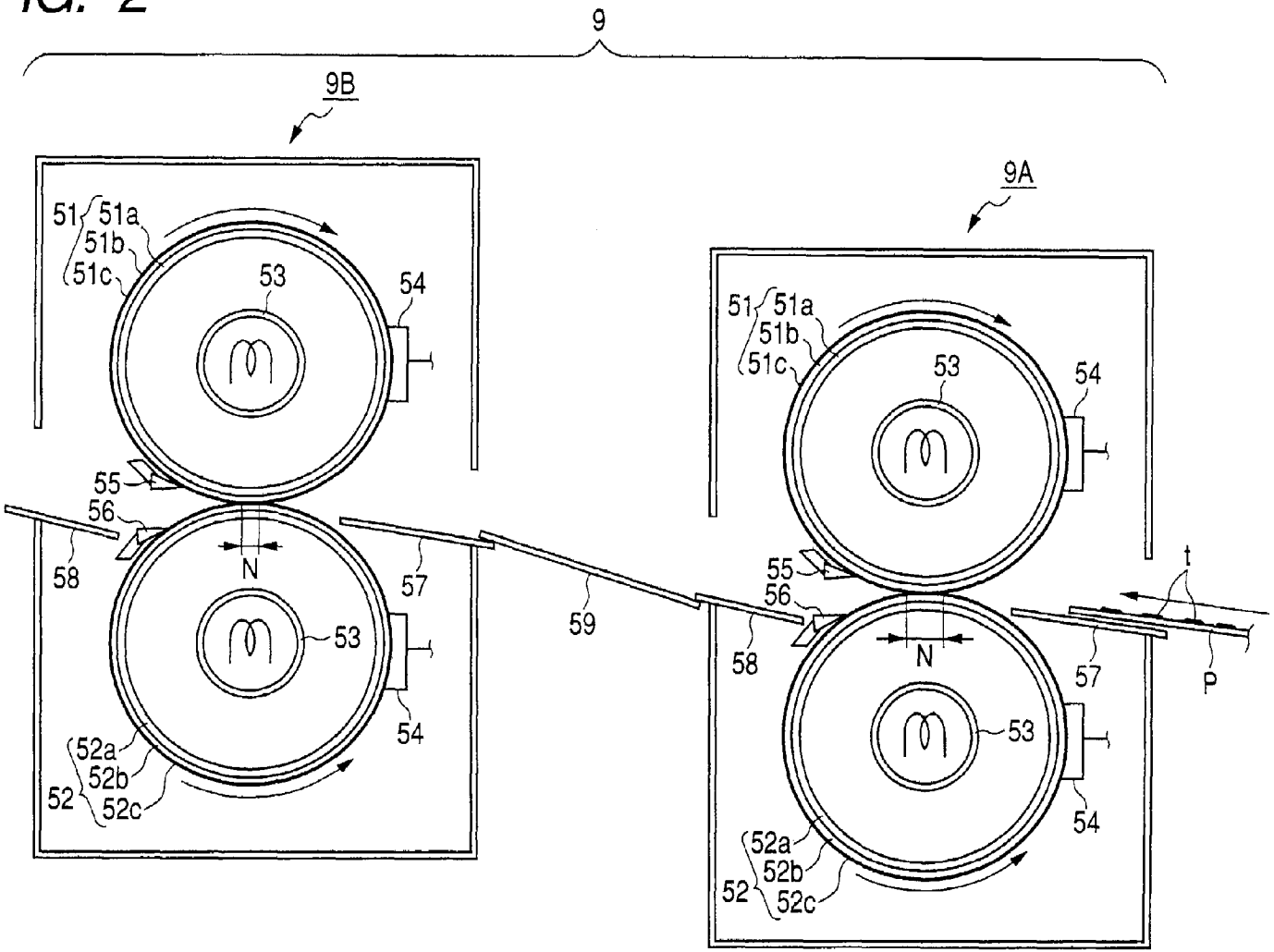
FIG. 2 is an enlarged view of first and second fixing apparatus portions.

FIG. 2 is an enlarged view of the image heating apparatus 9 having the two, the first and second, fixing devices 9A and 9B arranged in series. Of the first and second fixing devices 9A and 9B, the fixing device 9A is situated on the upstream side, and the second fixing device 9B is situated on the downstream side, with respect to the recording material conveying direction.

The first and second fixing devices 9A and 9B according to this embodiment are both heat roller type fixing devices. That is, the fixing devices 9A and 9B each have a fixing roller 51 and a pressurizing roller 52 as image heating members (fixing members). The pressurizing roller 52 is held in press contact with the fixing roller 51, forming a nip portion (fixing nip portion) N. The fixing roller 51 is driven to rotate clockwise as indicated by the arrow by a drive system (not shown). The pressurizing roller 52 rotates following the rotation of the fixing roller 51.

More specifically, the fixing roller 51 used had an outer diameter of approximately ϕ80 mm, which was composed of a hollow cored bar 51*a* formed of Al and having an outer diameter of ϕ75.0 mm, an elastic layer 51*b* consisting of silicon rubber having a rubber hardness of 20° (JIS-A, 1 kg applied load) and formed on the hollow cored bar 51*a* at a thickness of 2.5 mm in the first fixing device 9A and at a thickness of 1.5 mm in the second fixing device 9B, and a PFA tube of 50 μm in thickness coated as a release layer 51*c* on the surface of the elastic layer 51*b*.

The fixing roller 51 has a halogen heater 53 as a heating source provided therein; electric power is supplied to the halogen heater 53 from a power source portion (not shown), and internal heating of the fixing roller 51 is effected through heat generation by the halogen heater 53. The surface temperature of the fixing roller 51 is detected by a temperature sensor 54 such as a thermistor serving as a temperature detecting member arranged in contact or non-contact with the fixing roller 51, and the information on the detected temperature is input to a temperature control circuit (not shown). The temperature control circuit controls power supply from the power source to the halogen heater 53 so that the above detected temperature, information on which is input to the temperature control circuit from the temperature sensor 54, is maintained at a predetermined control temperature. In this embodiment, temperature adjustment is effected such that the surface temperature of the fixing roller 51 is maintained at 180° C. in the first fixing device 9A, and that the surface temperature of the fixing roller 51 is maintained at 200° C. in the second fixing device 9B.

Some color image fixing devices use, instead of the surface release layer 51*c* of the fixing roller 51, a silicon rubber layer or a fluororubber layer impregnated with silicon oil; the present invention is also applicable to fixing devices using such a rubber layer.

The pressurizing roller 52 used had an outer diameter of ϕ78 mm, which was composed of a hollow cored bar 52*a* formed of Al and having an outer diameter of ϕ75.0 mm, an elastic layer 52*b* made of silicon rubber having a rubber hardness of 16° (JIS-A, 1 kg applied load) and formed at a thickness of 2.0 mm in the first fixing device 9A and at a thickness of 1.5 mm in the second fixing device 9B, and a PFA tube of 50 μm in thickness coated as a release layer 52*c* on the surface of the elastic layer 52*b*.

In this embodiment, the pressurizing roller 52 also has the halogen heater 53 as a heating source arranged therein, and electric power is supplied to the halogen heater 53 from a power source portion (not shown), with the internal heating of the pressurizing roller 52 being effected through heat generation by the halogen heater 53. The surface temperature of the pressurizing roller 52 is detected by the temperature sensor 54 such as a thermistor arranged in contact or non-contact with the pressurizing roller 52, and the information on the detected temperature is input to a temperature control circuit (not shown). The temperature control circuit controls power supply from the power source to the halogen heater 53 so that the above detected temperature, information on which is input to the temperature control circuit from the temperature sensor 54, is maintained at a predetermined control temperature. In this embodiment, temperature adjustment is effected such that the pressurizing roller 52 of the first fixing device 9A and the pressurizing roller 52 of the second fixing device 9B are both maintained at a surface temperature of 140° C.

In the first fixing device 9A, the pressurizing roller 52 pressurizes the fixing roller 51 with a total pressure of 700 N, forming a fixing nip portion N of approximately 10 mm in width. Further, in the second fixing device 9B, the pressurizing roller 52 pressurizes the fixing roller 51 with a total pressure of 1000 N, forming a fixing nip portion N of approximately 5 mm in width.

Recording material separation members 55 and 56 are arranged on the fixing roller 51 side and on the pressure roller 52 side, respectively, in the vicinity of the recording material exit side of the fixing nip portion N. Hereinbelow, the recording material separation member 55 on the fixing roller 51 side is referred to as the upper separation claw, and the recording material separation member 56 on the pressurizing roller 52 side is referred to as the lower separation claw.

With the fixing roller 51 and the pressurizing roller 52 of each of the first and second fixing members 9A and 9B being rotationally driven and temperature-adjusted through heating to a predetermined surface temperature, the recording material P on which an unfixed toner image t is borne and which is sent from the image creating portion side is introduced to the fixing nip portion N of the first fixing device 9A while being guided by an entrance side guide 57. As it is nipped and conveyed at the fixing nip portion N, the recording material P thus introduced undergoes toner image fixing processing by heat and pressure. The recording material P having exit the fixing nip portion N is separated from the surface of the fixing roller 51 or the pressurizing roller 52 by the upper separation claw 55 or the lower separation claw 56 and introduced to the second fixing device 9B as it is guided by an exit side guide 58 and a bridging guide 59; thereafter, the recording material P is introduced to the fixing nip portion N of the second fixing device 9B as it is guided by the entrance side guide 57. At the fixing nip portion N, the recording material P thus introduced is again subjected to toner image fixing processing by heat and pressure while being nipped and conveyed. The recording material P having exit the fixing nip portion N is separated from the surface of the fixing roller 51 or the pressurizing roller 52 by the upper separation claw 55 or the lower separation claw 56 and exits the second fixing device 9B as it is guided by the exit side guide 58.

The construction of the upper and lower separation claws 55 and 56 is different between the first fixing device 9A and the second fixing device 9B. This is described in detail below.

1) Separation Claw Construction on the First Fixing Device 9A Side

Figure 3:
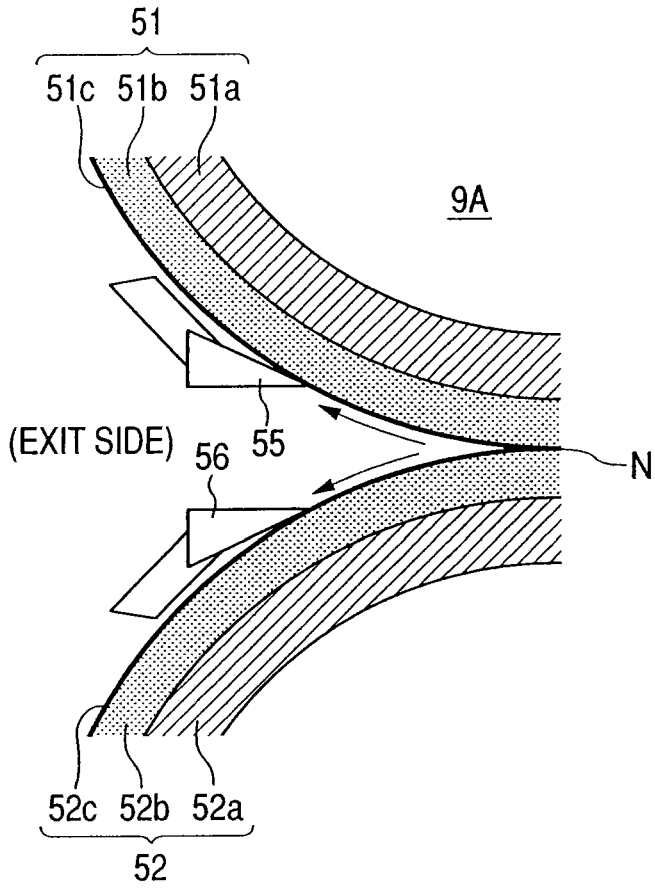
FIG. 3 is an enlarged view of upper and lower separation claw portions on a first fixing apparatus side.
Figure 4:
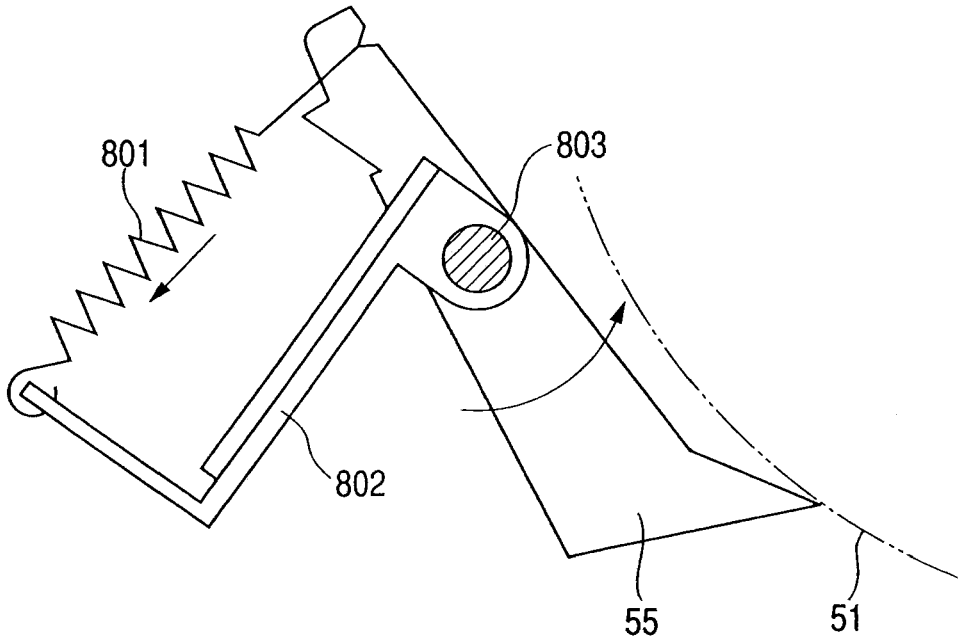
FIG. 4 is an explanatory structural view of the upper separation claw.

FIG. 3 is an enlarged view of the upper and lower separation claws 55 and 56 on the first fixing device 9A side as shown in FIG. 2, and FIG. 4 is an explanatory structural view of the upper separation claw 55. The upper separation claw 55 and the lower separation claw 56, which are arranged on the exit side of the first fixing device 9A, are contact separation claws adapted to abut on the surfaces of the fixing roller 51 and the pressurizing roller 52, respectively. As shown in FIG. 4, the upper separation claw 55 has a sharp distal end and supported by a holder 802 fixed to a fixing unit frame (not shown) so as to be rotatable about a shaft 803. The upper separation claw 55 is urged by a spring 801 to rotate so as to bring its distal end into abutment against the surface of the fixing roller 51, thereby abutting the distal end of the upper serration claw on the surface of the fixing roller 51 with an applied pressure on the order of 0.01 to 0.03 N. The surface of the upper separation claw 55 is preferably treated with fluororesin for improved slidability on the fixing roller 51. The upper separation claw 55 has a width on the order of 10 mm, so that it does not easily damage the fixing roller 51 surface. More preferably, the upper separation claw 55 is equipped with a reciprocation mechanism allowing the abutment position of the claw to change with time.

The upper separation claw 55 prevents the recording material from enwinding onto the fixing roller 51 even in the following cases: when the image density of the recording material is high; when the printing environment is a high humidity environment and the recording material lacks stiffness; when the recording material is thin paper and lacks stiffness; and when satisfactory toner fusion cannot be expected due to a drop in the surface temperature of the fixing roller 51. The upper separation claw 55 thus acts to reliably carry the recording material to the second fixing device 9B.

The lower separation claw 56 adopts the same material and construction as those of the upper separation claw 55 and abuts on the surface of the pressurizing roller 52. The lower separation claw 56 prevents the recording material from enwinding onto the pressurizing roller even when the image density of the second print surface is high in the duplex printing mode. The lower separation claw 56 thus acts to reliably carry the recording material to the second fixing device 9B.

Figure 5:
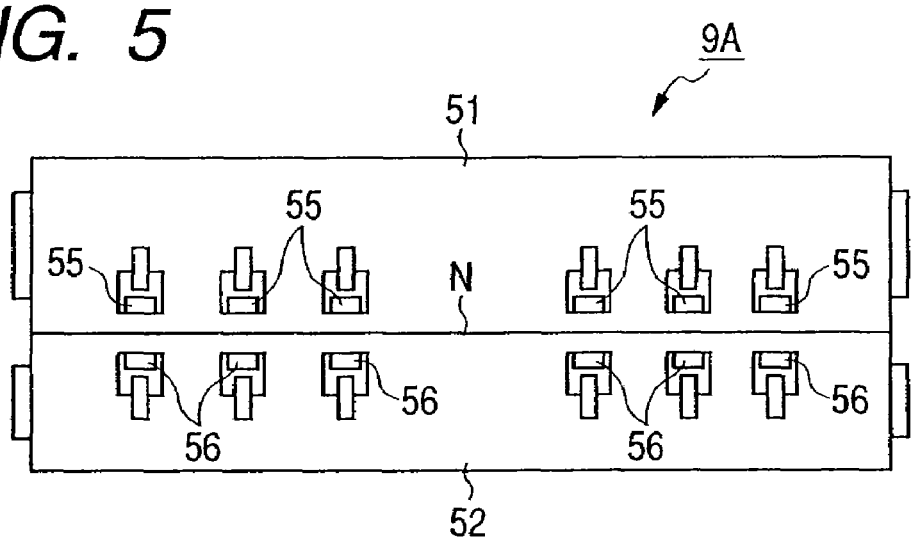
FIG. 5 shows an arrangement of the upper and lower separation claws as viewed from the longitudinal direction of a fixing roller and a pressurizing roller on the first fixing apparatus side.

FIG. 5 shows arrangement of the upper separation claw 55 and the lower separation claw 56 as seen in the longitudinal direction of the fixing roller 51 and the pressurizing roller 52. The upper separation claw 55 and the lower separation claw 56 are each arranged at six locations in the longitudinal direction of the fixing roller 51 and the pressurizing roller 52, respectively.

2) Separation Claw Construction on the Second Fixing Device 9B Side

Figure 6:
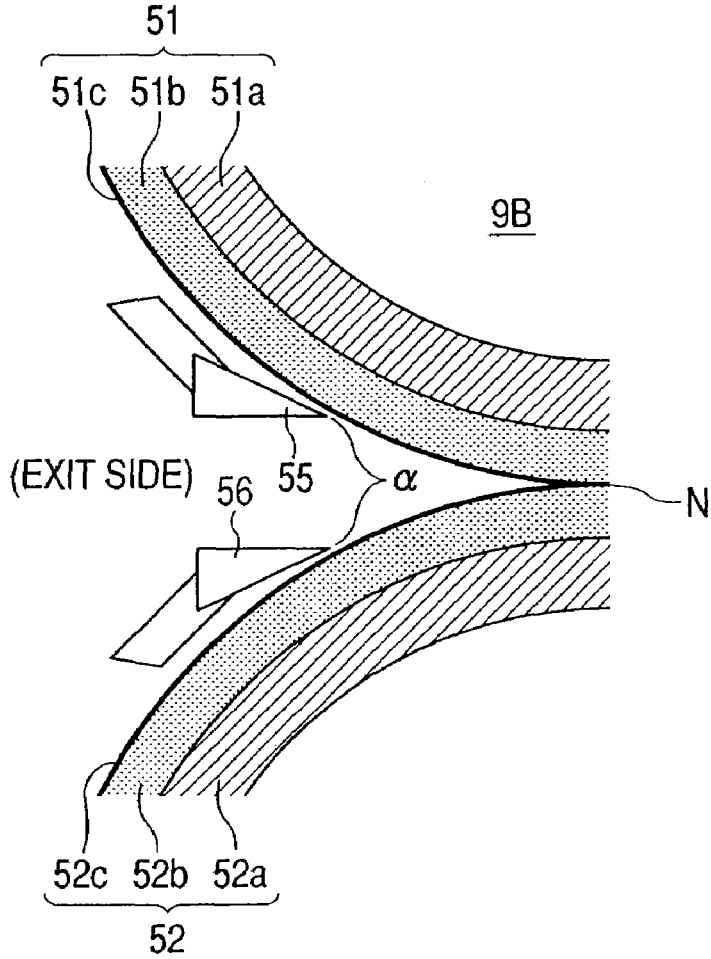
FIG. 6 is an enlarged view of upper and lower separation claw portions on a second fixing apparatus side.

FIG. 6 is an enlarged view of the upper and lower separation claws 55 and 56 on the second fixing device 9B side as shown in FIG. 2. The upper separation claw 55 and the lower separation claw 56, which are arranged on the exit side of the second fixing device 9B, are non-contact separation claws not abutting on the surfaces of the fixing roller 51 and the pressurizing roller 52, respectively. Unlike the upper separation claw 55 on the first fixing device 9A side, the upper separation claw 55 on the second fixing device 9B side is not pressurized onto position but fixed to the fixing frame, so that it is arranged without abutting on, that is, in non-contact with, the fixing roller 51. The distal end of the upper separation claw 55 is position-adjusted to be arranged at a gap a of 0.5 mm to 2.0 mm from the fixing roller 51 surface at the time of shipment from the factory.

The lower separation claw 56 is of the same construction as the upper separation claw 55 and arranged without abutting on, that is, in non-contact with, the pressurizing roller 52.

In this second fixing device 9B as well, the upper and lower non-contact separation claws 55 and 56 are arranged in the same manner as in the first fixing device 9A shown in FIG. 5.

If no separation member is arranged on the second fixing device 9B side, the sheet discharge direction changes on the second fixing device 9B side due to variations in the image density, balance between the lower and upper roller temperatures, amount of water in the recording material, stiffness of the recording material, and the like, making it impossible to obtain stable sheet conveyance property. In fact, when no separation member was provided on the second fixing device 9B, a curled sheet entered between the fixing unit and the rollers, resulting in jam.

In a heat-roller-pair type fixing device with which toner formed of resin as its base material is heated, pressurized, and conveyed by means of a heat roller pair as in this embodiment, the viscosity of the toner resin increases as an unfixed toner is fused by heat, causing an increase in the affinity with the fixing roller. In this case, when the printing environment is a high humidity environment and the recording material lacks stiffness, or when the recording material is thin paper and lacks stiffness, the affinity of the toner with the fixing roller overcomes the separation force due to the sheet stiffness and sheet conveyance, which disadvantageously causes the recording material to enwind onto the fixing roller 51. Further, undesirable enwinding of the recording material onto the fixing roller 51 also occurs when, during continuous printing or the like, sufficient toner fusion cannot be expected due to a drop in the surface temperature of the fixing roller 51. Such enwinding onto the fixing roller causes a jam, making it necessary for the user to remove the sheet enwinding onto the fixing portion and the jammed sheet remaining inside the machine, resulting in a marked reduction in operability and productivity.

On the other hand, as the separation claw is abutted on the fixing roller, its sliding movement on the fixing roller surface leaves a slight sliding scar. Further, the image immediately after discharge rubs against the claw, resulting in uneven gloss. A method for overcoming those problems is to improve the slidability by abutting an oil-impregnated cloth (web) on the fixing roller surface, or to make the uneven gloss, which results from the image rubbing against the claw, inconspicuous by suppressing the image gloss through use of a hard toner that does not readily melt.

Those methods, however, do not provide a fundamental solution as it is difficult to obtain a high-gloss image while suppressing uneven gloss in the claw portion.

In this embodiment, as described above, the upper and lower separation claws 55 and 56 as separation members are arranged in a contact manner in the first fixing device 9A, and the upper and lower separation claws 55 and 56 as separation members are arranged in a non-contact manner in the second fixing device 9B.

Table 1 below shows the results of comparison on the discharge performance, gloss unevenness, and longevity between a construction employing no second fixing device 9B and provided with only the first fixing device 9A (Comparative Example 1: after first fixing), a construction adopting the construction of Comparative Example 1 and in which the separation claw is arranged in a non-contact manner (Comparative Example 2: first fixing with non-contact claws), and the construction of this embodiment.

TABLE 1

| | Discharge property | Gloss unevenness |
|---|---|---|
| Comparative Example 1 (after first fixing) | ○ | x |
| Comparative Example 2 (first fixing with non-contact claws) | x | ○ |
| This embodiment | ○ | ○ |

While Comparative Example 1 provides a good discharge performance with no enwinding onto the fixing roller because the separation claw is of the contact type, uneven gloss occurred due to rubbing of the image against the claw. In Comparative Example 2, enwinding onto the fixing roller occurred in the case of thin paper or an image with a high image density. This embodiment provided a satisfactory image with no gloss unevenness while exhibiting a satisfactory discharge property.

Figure 7:
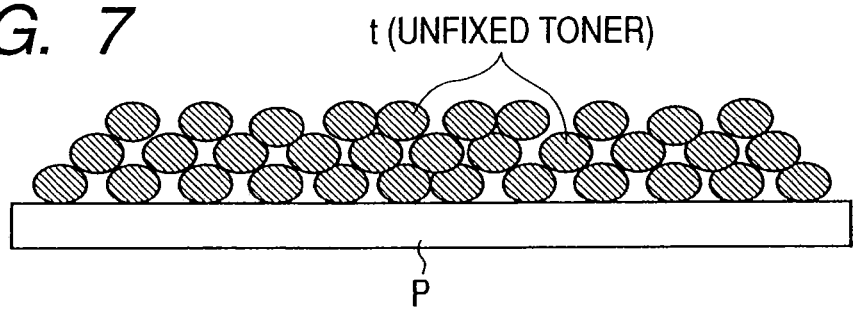
FIG. 7 is a schematic conceptual sectional view of an image before fixation.

The mechanism for achieving the above results is presumed as follows. That is, in the case of an image prior to fixing (hereinafter referred to as the "unfixing image"), unfixed toner particles are laminated in the form of powder on the recording material, with air intervening between individual toner particles. FIG. 7 is a schematic conceptual sectional view of the unfixed image (unfixed toner) t.

Figure 8:
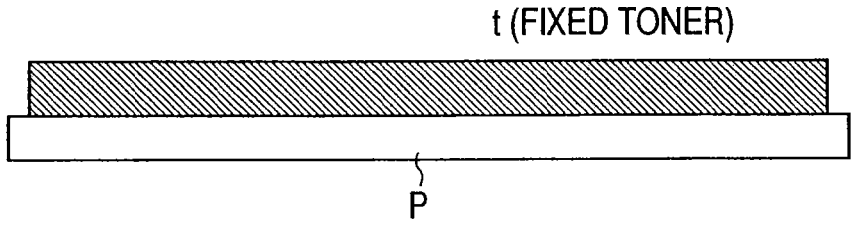
FIG. 8 is a schematic conceptual sectional view of an image after fixation by the first fixing apparatus.

On the other hand, as for an image after fixing by the first fixing device 9A (after first fixing), the air between individual toner particles is exhausted as the powdery toner particles on the recording material are once fused by heat. FIG. 8 is a schematic conceptual sectional view of the image after first fixing (fixed toner).

In fact, in this embodiment, toner particles of three colors each having a particle size of 7 microns are transferred in an overlapping manner onto the recording material, and hence the total toner height on the order of 21 microns results; however, the actual total toner height after the first fixing was on the other of 12 microns. In this regard, usually, about 30% to 50% of an unfixed toner image consists of empty space, allowing intrusion of air. Such air intruding into the toner layer acts as a heat insulation layer, resulting in a marked deterioration in thermal conductivity. In contrast, a toner that has been fixed contains no air because such an empty space is filled up as the toner fuses, and exhibits good thermal conductivity due to the binding of the toner particles.

When sufficiently fused by heat, the toner decreases in viscosity into a fluidized liquid, whereby release components such as wax contained in the toner efficiently function to achieve satisfactory separation performance. On the other hand, when the thermal conductivity of the toner is poor, it is difficult for the release components such as wax contained in the toner to function efficiently. Moreover, the resulting delay in toner fusion makes it difficult for the toner viscosity to readily decrease, with the result that the toner viscosity is high even at the exit of the fixing nip portion, leading to increased occurrences of recording material enwinding onto the fixing roller.

Further, once the toner image has been fixed, release components such as wax contained in the toner are deposited on the toner layer surface, forming a film, whereby the affinity with the fixing roller is low and thus enwinding is not liable to occur.

Further, once fixing is complete, the recording material increases in stiffness as the moisture evaporates, making it possible to obtain satisfactory release performance.

Further, fixing for a second time (second fixing) by the second fixing device 9B effects fixing on the toner surface again, whereby disturbances in the image surface such as gloss unevenness generated during the first fixing are corrected, making it possible to obtain satisfactory image property.

On the basis of the above presumed mechanism, discharge property more favorable than that attained by the first fixing can be attained by the second fixing even when the separation claw is arranged in a non-contact manner. Further, the uneven gloss generated during the first fixing due to rubbing of the image against the claw can be rendered inconspicuous by performing the second fixing, that is, by performing fixing twice. Further, the separation claw is arranged in a non-contact manner for the second fixing, whereby chipping wear due to sliding movement of the claw is obviated, enabling an extended longevity as compared with the first fixing.

Embodiment 2

In this embodiment, the image forming apparatus used was of the same type as that used in Embodiment 1 (FIG. 1). According to this embodiment, while the first fixing device 9A was unchanged from the first fixing device 9A of Embodiment 1, the second fixing device 9B was changed from the second fixing device 9B of Embodiment 1 but only with respect to the separation claw construction.

Figure 9:
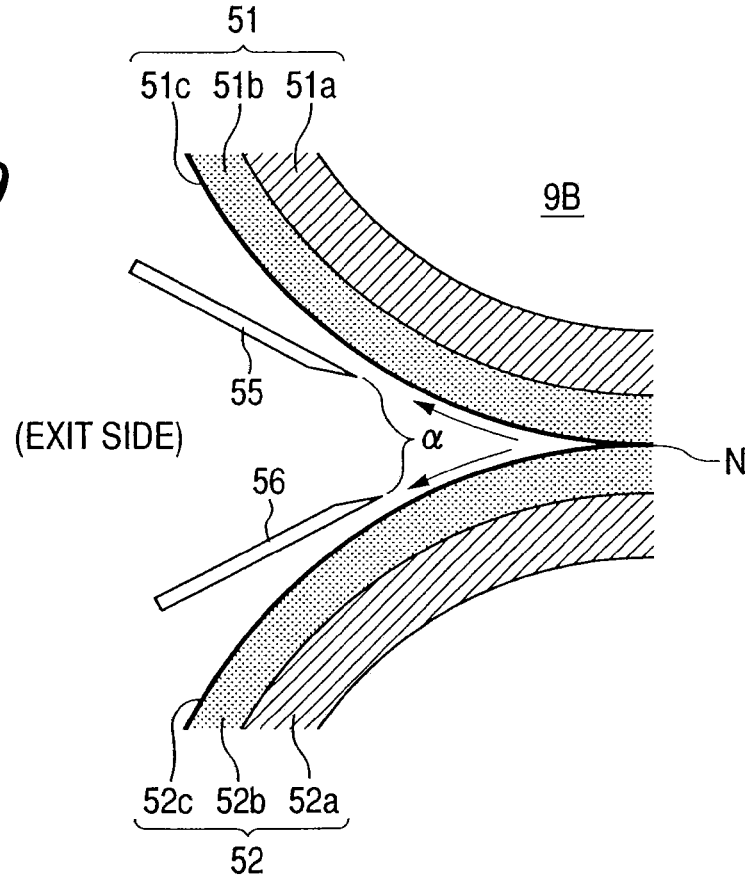
FIG. 9 is an enlarged view of upper and lower separation claw (spaced sheet metal) portions on a second fixing apparatus side according to Embodiment 2 of the present invention.
Figure 10:
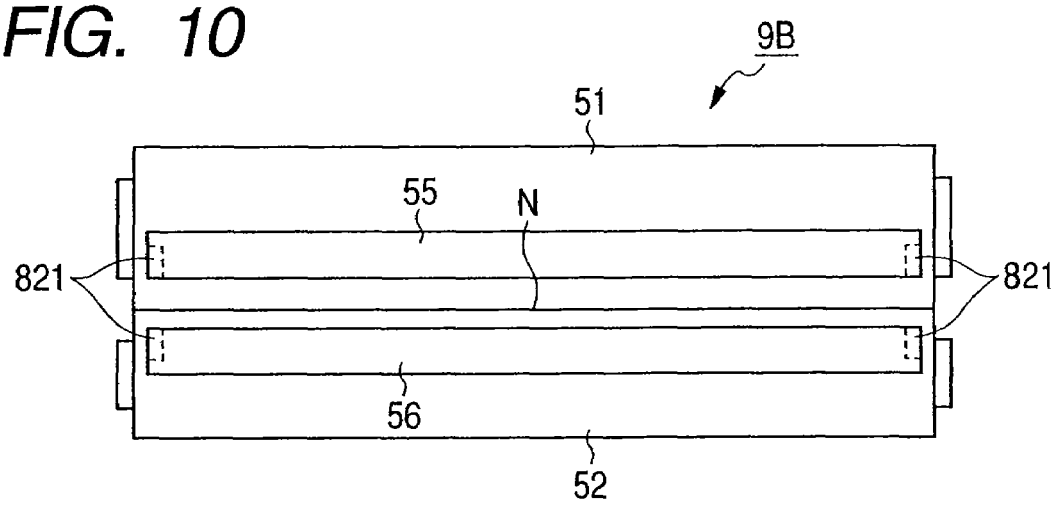
FIG. 10 shows an arrangement of the upper and lower separation claws as viewed from the longitudinal direction of a fixing roller and a pressurizing roller.
Figure 11:
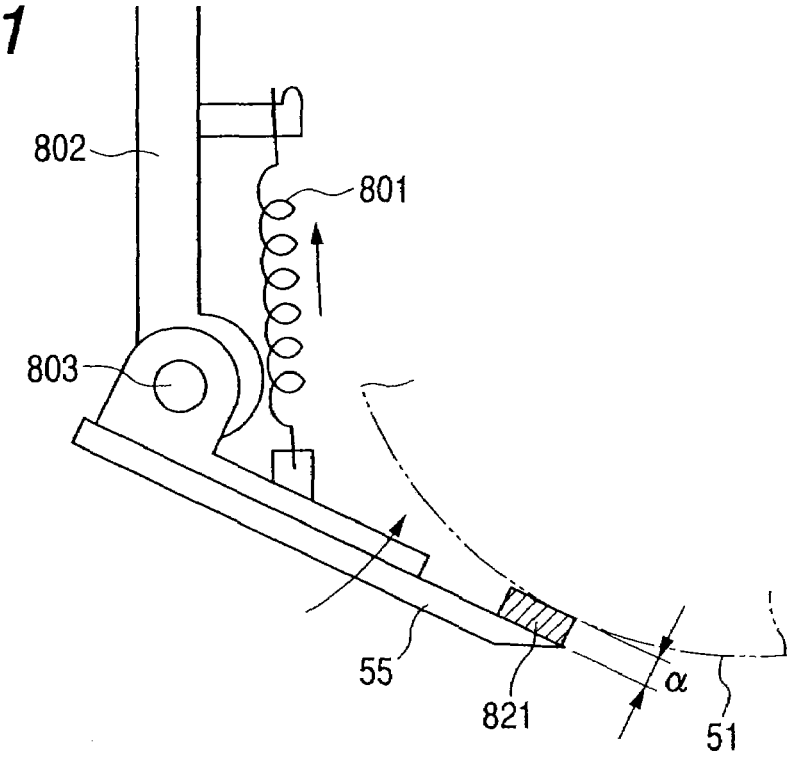
FIG. 11 is an explanatory structural view of the upper separation claw.

That is, as shown in FIG. 9 through 11, in this embodiment, the non-contact type upper and lower separation claws 55 and 56 of the second fixing device 9B are each constructed in the form of sheet metal with a sharp distal end (hereinafter, such a separation claw is referred to as the separation sheet metal). The surfaces of the upper and lower separation sheet metals 55 and 56 are treated with fluororesin that provides good toner release property. The upper and lower separation sheet metals 55 and 56 are arranged on the exit side of the second fixing device 9B and are non-contact separation sheet metals not abutting on the surfaces of the fixing roller 51 and the pressurizing roller 52, respectively.

As shown in FIG. 10, the upper and lower separation sheet metals 55 and 56 are formed substantially like guides extending over the lengths of the fixing roller 51 and the pressurizing roller 52, respectively. The upper and lower separation sheet metals 55 and 56 are in close proximity to the fixing roller 51 and the pressurizing roller 52, respectively, while maintaining a fixed distance (gap a) therebetween. The gap a between the distal ends of the upper and lower separation sheet metals 55 and 56 and the surfaces of the fixing roller 51 and the pressurizing roller 52 is maintained at 1.0 mm by abutting spacers 821 at opposite ends of the separation sheet metals 55 and 56 against the fixing roller 51 and the pressurizing roller 52, respectively.

More specifically, referring to FIG. 11 showing the arrangement of the upper separation sheet metal 55, the upper separation sheet metal 55 is supported by a holder 802 fixed to a fixing unit frame (not shown) so as to be rotatable about a shaft 803, and the upper separation sheet metal 55 is urged by a spring 801 to rotate such that its distal end moves toward the fixing roller 51, thereby bringing the spacers 821 at the opposite ends of the upper separation sheet metal 55 into abutment against the fixing roller 51, whereby the gap $\alpha$ is formed between the distal end of the upper separation sheet metal 55 and the surface of the fixing roller 51.

The lower separation sheet metal 56 adopts the same construction as the upper separation sheet metal 55 described above, with the gap a being formed between it and the surface of the pressurizing roller 52.

While other methods may be used to guarantee the gap a between the distal ends of the separation sheet metals 55 and 56 and the surfaces of the fixing roller 51 and the pressurizing roller 52, respectively, in any case, the gap $\alpha$ is preferably in the range of 0.5 mm to 2.0 mm.

This embodiment also provides discharge property similar to that attained by Embodiment 1, and it is possible to make uneven gloss, which is generated during the first fixing as the image rubs against the contacting separation claws 55 and 56, inconspicuous. Further, the separation claws (separation sheet metals) 55 and 56 are arranged in a non-contact manner in the second fixing, whereby chipping wear resulting from the sliding movement of the separation claws is obviated, leading to an extended longevity as compared with the first fixing.

Embodiment 3

In this embodiment, the image forming apparatus used was of the same type (FIG. 1) as that used in Embodiment 1. According to this embodiment, while the second fixing device 9B was unchanged from the second fixing device 9B of Embodiment 1, the first fixing device 9A was changed from the first fixing device 9A of Embodiment 1 but only with respect to the construction of the separation members.

This embodiment adopts a construction in which the hardness of the fixing roller 51 is made lower than the hardness of the pressurizing roller 52 by using low-hardness rubber for the elastic layer 51*b* of the fixing roller 51.

The fixing roller 51 was constructed as follows.

Rubber thickness 2.5 mm

Surface layer fluororesin 50 μm-thickness coating

Effective surface hardness 69° (Asker-C, 1 kg applied load)

Rubber piece hardness 10° (JIS-A, 1 kg applied load)

Further, the pressurizing roller 52 was constructed as follows.

Rubber thickness 2.0 mm

Surface layer fluororesin 50 μm-thickness coating

Effective surface hardness 75° (Asker-C, 1 kg applied load)

Rubber piece hardness 16° (JIS-A, 1 kg applied load)

With the above constructions, the recording material is discharged from the fixing nip portion N in a downward direction, whereby satisfactory separation performance can be attained without bringing the upper separation claw 55 on the fixing roller 51 side into abutment.

Figure 12:
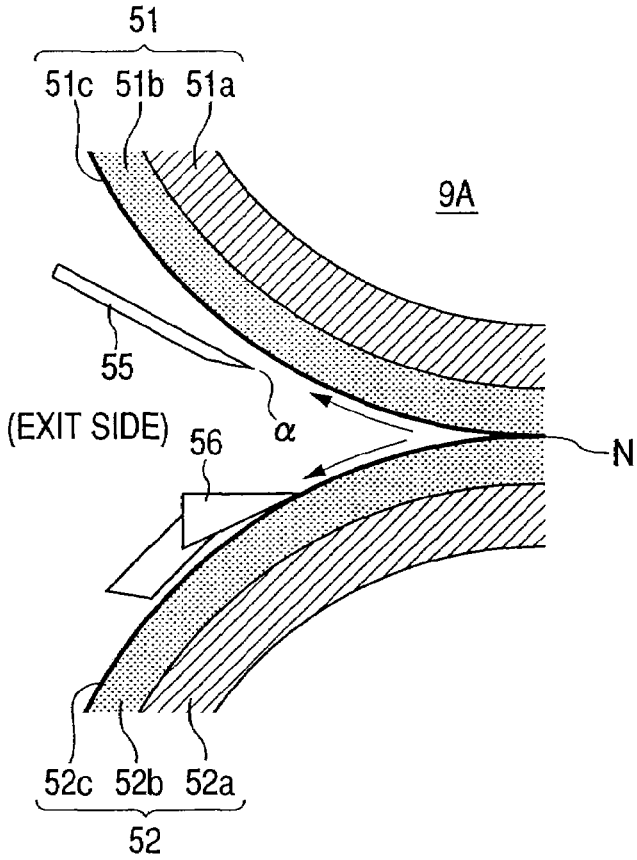
FIG. 12 is an enlarged view of upper and lower separation claw portions on a first fixing apparatus side according to Embodiment 3 of the present invention.

Accordingly, as shown in FIG. 12, this embodiment uses as the upper separation claw 55 of the first fixing device 9A the same non-contact separation sheet metal 55 (FIGS. 9 through 11) as that of Embodiment 2. On the other hand, since there is a fear of the recording material P enwinding onto the pressurizing roller 52 during duplex printing, the same contact separation claw 56 as that of Embodiment 1 is used as the lower separation claw 56 to achieve satisfactory conveyance property.

The results equivalent to those of Embodiments 1 and 2 were obtained by thus using the first fixing device 9A constructed as described above and the second fixing device 9B of the same construction as that of Embodiment 1.

Embodiment 4

In this embodiment, the image forming apparatus used was of the same type (FIG. 1) as that used in Embodiment 1. According to this embodiment, while the second fixing device 9B was unchanged from the second fixing device 9B of Embodiment 1, the construction of the first fixing device 9A is different from that of the first fixing device 9A of Embodiment 1.

Figure 13:
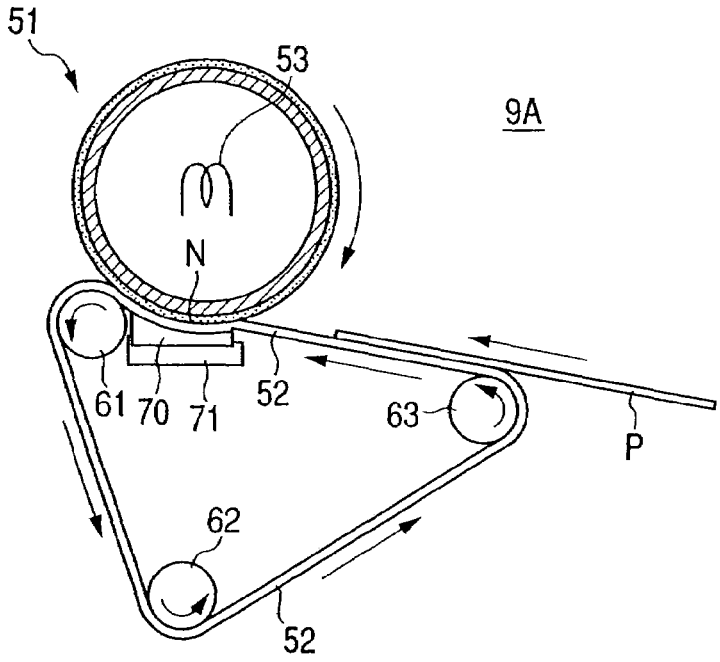
FIG. 13 is a schematic structural diagram of a first fixing apparatus according to Embodiment 4 of the present invention.

That is, as shown in FIG. 13, this embodiment uses as the first fixing device 9A a fixing device of a belt-fixing structure, in which an endless pressurizing belt (fixing belt), which is suspended in tension between a plurality of rollers 61 through 63, is used as the pressurizing roller 52, and the pressurizing belt 52 is abutted on the fixing roller 51 and pressurizes on the fixing roller 51 from inside the pressurizing belt 52 by means of a pressurizing member having a pressurizing pad 70 and a pressurizing pad supporting portion 71, thus forming the fixing nip portion N.

The fixing roller 51 is driven to rotate clockwise as indicated by the arrow. The pressurizing belt 52 rotates in the direction of the arrows following the rotation of the fixing roller 52.

The fixing roller 51 consists of a cored bar formed of Al, Fe, or the like, and an elastic layer made of silicon rubber, fluororesin rubber, or the like coated on the cored bar. The pressurizing roller 52 consists of a base made of resin such as polyimide or metal such as nickel, and an elastic layer made of silicon rubber, fluororesin rubber, or the like coated on the surface of the base.

The fixing roller 51 has the heater 53 such as a halogen lamp arranged therein. Further, a thermistor (not shown) is arranged in a contact or non-contact manner in the fixing roller 51; temperature adjustment is effected on the surface of the fixing roller 51 by controlling the applied voltage to the heater 53 through the intermediation of a temperature adjustment circuit.

Of the rollers 61 through 63 around which the pressuring belt 52 is suspended, the roller 61 is a separation roller made of metal. The roller 61 is pressurized so as to dig into the fixing roller 51 through the intermediation of the pressurizing belt 52, causing the elastic layer of the fixing roller 51 to deform to thereby separate the recording material P from the fixing roller 51 surface.

When the fixing nip portion N is thus formed by the fixing roller 51, the endless pressurizing belt 52, and the pressurizing pad 70, a fixing nip portion N of a large width can be formed so that the recording material P is wound onto the outer periphery of the fixing roller 51 by means of the pressurizing belt 52, which is advantageous for high speed operation.

Further, the separation roller 61 is pressurized so as to dig into the fixing roller 51, thus providing even more improved separation property than that attained in Embodiment 3, which is advantageous for high speed operation.

In conventional fixing devices employing a roller pair construction, a large nip width can be secured only by increasing the thickness of the elastic layer, which is disadvantageous from the viewpoint of energy saving. In contrast, a fixing device using the pressurizing belt 52 as described above makes it possible to form a wide nip without increasing the thickness of the elastic layer of the fixing roller 51, whereby heat transfer loss due to the elastic layer can be avoided to achieve effective energy saving.

As in Embodiment 3, also with the above construction, the direction of discharge of the recording material P from the fixing nip portion N is a downward one, whereby satisfactory separation performance can be attained without bringing the upper separation claw on the fixing roller 51 side into abutment.

Figure 14:
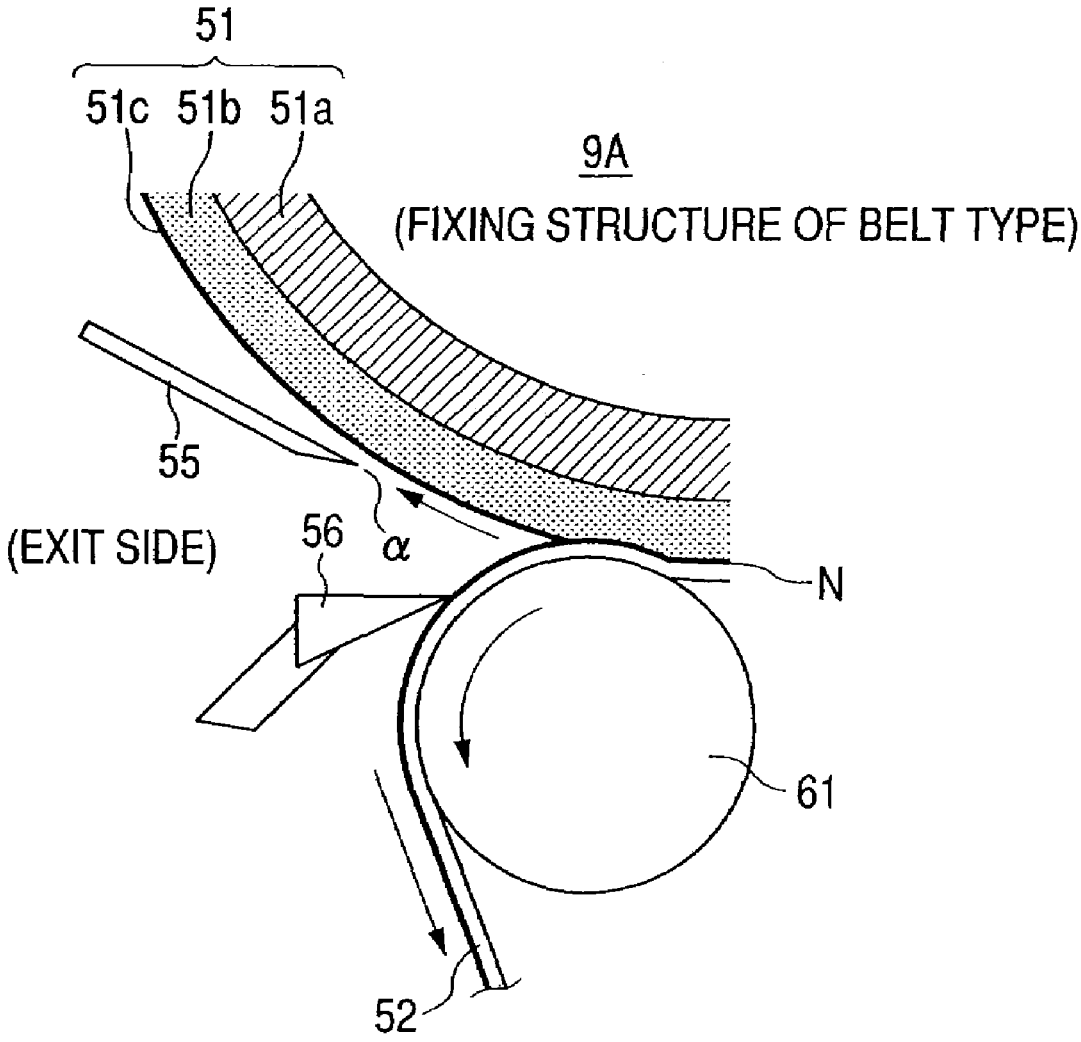
FIG. 14 is an enlarged view of upper and lower separation claw portions.

As shown in FIG. 14, in this embodiment, the same non-contact separation sheet metal 55 as that of Embodiment 2 is used as the upper separation claw equipped to the first fixing device 9A that is a fixing device employing a belt-fixing structure. On the other hand, since there is a fear of the recording material P enwinding onto the pressurizing belt 52 during duplex printing, the same contact type lower separation claw 56 as that of Embodiment 1 is used as the lower separation claw, thereby achieving satisfactory conveyance property.

With the above construction of the first fixing device 9A, too, the results equivalent to those of Embodiments 1 and 2 were obtained by using the fixing device 9B constructed as in Embodiment 1 as the second fixing device.

Embodiment 5

According to this embodiment, in the construction of Embodiment 1, the upper and lower non-contact separation claws 55 and 56 of the second fixing device 9B are formed as the same contact type separation claws as the upper and lower contacting separation claws 55 and 56 of the first fixing device 9A. It is to be noted, however, that the contact force with which the separation claws 55 and 56 contact the fixing roller 51 and the pressurizing roller 52, respectively, is 0.01 to 0.03 N in the first fixing device 9A, whereas the contact force with which the separation claws 55 and 56 contact the fixing roller 51 and the pressurizing roller 52, respectively, is set smaller in the second fixing device 9B, at 0.005 to 0.01 N. In this embodiment, the contact area over which the contact separation claws contact the target contact object is substantially the same between the first fixing device 9A and the second fixing device 9B. Further, the contact force can be measured by measuring the maximum applied force at which the target contact object and the separation claw are separated apart from each other from their contacting state. It is to be noted that the contact pressure can be derived from the following expression: contact pressure=(contact force)/(contact area).

Since, as described above, the contact area is substantially the same between the first and second fixing devices, the contact pressure of the separation claws is lower in the second fixing device than the contact pressure of the separation claws in the first fixing device.

The above construction provides discharge property similar to that attained in Embodiment 1, and uneven gloss, which is generated in the first fixing device 9A (first fixing) as the image rubs against the separation claws, can be rendered inconspicuous. Further, even through the separation claws 55 and 56 are brought into contact with their associated rollers in the second fixing device 9B (second fixing), the contact pressure at this time is set low, whereby high discharge stability can be attained and chipping wear due to the sliding movement of the separation claws is mitigated, leading to extended longevity as compared with the first fixing.

While the foregoing description is directed to the case where, as the separation members of Embodiments 1 through 4, the abutting-type separation claws are used as contact type separation members and the separating claws of non-contacting arrangement and guide-like separation sheet metals are used as non-contact type separation members, the present invention is by no means limited to those constructions.

In Embodiments 1 through 4 as described in the foregoing, the image on the recording material is heated successively by the first image-heating means and the second image-heating means. However, another alternative construction may be adopted in which a conveyance path not passing through the second image-heating means is provided between the first image-heating means and the second image-heating means, with the recording material being not conveyed to the second image-heating means depending on the thickness of the recording material, selected gloss, etc.

The number of the fixing devices is not limited to two, the first and second fixing devices, and three fixing devices or more may be arranged.

According to the foregoing embodiments, when applied to a construction where a plurality of image heating means are provided, the present invention makes it possible to keep image gloss unevenness low over a long period of time while securing separation property.

Further, when applied to an image forming apparatus for forming a color image, the present invention enables satisfactory discharge performance to be secured even in the following cases: the amount of overlaid toner has increased as toners of secondary color, tertiary color, and so forth are overlaid; the recording material lacks or has lost stiffness, such as when it is thin paper or used under a high-humidity environment; the surface temperature of the rotary heating member has decreased; and an image exists at the leading edge of the recording material. Therefore, high-speed fixing and high productivity can be realized.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 2004-109088 filed Apr. 1, 2004, which is hereby incorporated by reference herein.

What is claimed is:

1. An image heating apparatus comprising:

first and second image heating members which heat a toner image on a recording material at first and second nip portions, respectively; and first and second separating devices which separate the recording material from the first and second image heating members, respectively, wherein the first separating device includes a plurality of separation claws, and the second separating device includes a separation plate that is extended in a width direction of the recording material.

2. An image heating apparatus according to claim 1, wherein the separation claws are non-contact-type separating members that do not contact a surface of the first image heating member during an image heating process, and the separation plate is a non-contact-type separating member that does not contact a surface of the second image heating member during an image heating process.

3. An image heating apparatus according to claim 1, wherein the first and second image heating members are contactable with a side opposite to a side of the recording material on which the toner image is borne.

4. An image heating apparatus according to claim 1, wherein the first and second image heating members are contactable with a side of the recording material on which the toner image is borne.

5. An image heating apparatus according to claim 1, wherein the second image heating member is disposed at a downstream side of the first image heating member in a conveying direction of the recording material and heats the toner image heated by the first image heating member.

* * * * *

UNITED STATES PATENT AND TRADEMARK OFFICE

CERTIFICATE OF CORRECTION

PATENT NO. : 7,343,130 B2
APPLICATION NO. : 11/749934
DATED : March 11, 2008
INVENTOR(S) : Toshinori Nakayama It is certified that error appears in the above-identified patent and that said Letters Patent is hereby corrected as shown below:

ON THE TITLE PAGE
At Item (56), Foreign Patent Documents,
"11194684 A" should read --11-194684 A--;
"63192068 A" should read --63-192068 A--;
"06083221 A" should read --6-83221 A--; and
"2002123108 A" should read --2002-123108 A--.

COLUMN 1
Line 35, "includes" should read --include--.
Line 59, "an" should read --a--.

COLUMN 2
Line 56, "member" should read --members--.

COLUMN 8
Line 7, "exit" should read --exited--.

COLUMN 15
Line 12, "through" should read --though--.

Signed and Sealed this

Twenty-seventh Day of January, 2009

JOHN DOLL
*Acting Director of the United States Patent and Trademark Office*